US006923617B2

(12) United States Patent
Elexpuru

(10) Patent No.: US 6,923,617 B2
(45) Date of Patent: Aug. 2, 2005

(54) BIDIRECTIONAL HYDRAULIC PUMP

(75) Inventor: Anton Elexpuru, Mondragón (ES)

(73) Assignee: Fagor, S. Coop., Mondragon (ES)

( * ) Notice: Subject to any disclaimer, the term of this patent is extended or adjusted under 35 U.S.C. 154(b) by 0 days.

(21) Appl. No.: 10/675,426

(22) Filed: Sep. 29, 2003

(65) Prior Publication Data

US 2004/0071547 A1 Apr. 15, 2004

(30) Foreign Application Priority Data

Oct. 15, 2002 (ES) ..... 200202357

(51) Int. Cl.[7] ..... F01D 25/24
(52) U.S. Cl. ..... 415/127; 415/206; 415/211.2
(58) Field of Search ..... 415/126, 127, 415/128, 206, 208.1, 211.2

(56) References Cited

U.S. PATENT DOCUMENTS 3,147,909 A * 9/1964 Novitsky ..... 415/127
4,679,983 A * 7/1987 Pietryk et al. ..... 415/148
4,728,260 A * 3/1988 Ishii ..... 415/151

* cited by examiner

*Primary Examiner*—Ninh H. Nguyen
(74) *Attorney, Agent, or Firm*—The Kline Law Firm

(57) ABSTRACT

Bidirectional hydraulic pump that comprises a hydraulic body (1) comprising an inlet port (2) from which receives a water flow, a first outlet port (3) and a second outlet port (4); an impeller housed in said hydraulic body (1), which causes the water flow to move in either one direction or the other; and a valve body (5) that surrounds the impeller. The valve body (5) comprises at least one orifice (6) and said valve body (5) is slidable on the internal surface of the hydraulic body (1) in one direction or the other, due to the action of the water flow, between a first position wherein the orifice (6) is aligned with the first outlet port (3) and a second position wherein the orifice (6) is aligned with the second outlet port (4).

4 Claims, 2 Drawing Sheets

BIDIRECTIONAL HYDRAULIC PUMP

TECHNICAL FIELD

The present invention refers to bidirectional hydraulic pumps, and more particularly to bidirectional hydraulic pumps used in washing machines and dishwashers.

PRIOR ART

Some washing machines and dishwashers have the emptying of the waste water and recirculation of the washing water functions already included. These two functions can be carried out using two independent motors, one for each function, or using one bidirectional motor instead.

When a pump with a bidirectional motor is used, said pump comprises a hydraulic body with an inlet port that receives a water flow, a first outlet port for emptying and a second outlet port for recirculation. Hence, when the bidirectional motor turns in one direction, the water flow exits via one of the outlet ports and, when it turns in the opposite direction, the water flow exits via the other outlet port.

U.S. Pat. No. 5,486,089 describes a bidirectional hydraulic pump that comprises in the interior of the hydraulic body a movable member that moves due to the action of the water flow and blocks either one of the outlet ports or the other depending on the direction of the water flow. Due to the space between the outlet ports and the impeller, and to the positioning of the outlet ports (at right angles to the hydraulic body), a load loss is produced in the pump.

JP09137790 discloses a bidirectional pump comprising blocking flaps, hingedly joined to the hydraulic body, which close one outlet port or the other depending on the direction of the water flow. In this bidirectional pump, eddies may be produced in the area of closure of the outlet ports. In addition, the geometric configurations of this kind of bidirectional pumps are difficult to assemble.

JP09137790 also shows a bidirectional pump wherein the piece that closes both outlet ports is hingedly joined to the shaft of the impeller. Joining said piece to the shaft of the impeller may lead to potential reliability problems and cause hydraulic inefficiency.

DISCLOSURE OF THE INVENTION

The object of the invention is to provide a bidirectional hydraulic pump that overcomes some of the problems of the bidirectional hydraulic pumps of the prior art.

The bidirectional hydraulic pump of the invention comprises a hydraulic body comprising an inlet port which receives a water flow, a first outlet port and a second outlet port, and an impeller housed in said hydraulic body causing the water flow to move in either one direction or the other. The pump also comprises a valve body that surrounds the impeller, said valve body comprising at least one orifice.

The valve body is slidable on the internal surface of the hydraulic body in either direction due to the action of the water flow. Consequently, said valve body oscillates between a first position wherein said orifice is aligned with the first outlet port and a second position wherein said orifice is aligned with the second outlet port.

With the hydraulic pump of the invention load losses are minimised, simple and easy to assemble geometric configurations are obtained, and eddies which would be produced if the valve body was joined to the shaft of the impeller are avoided.

DETAILED DISCLOSURE OF THE INVENTION

Figure 1:
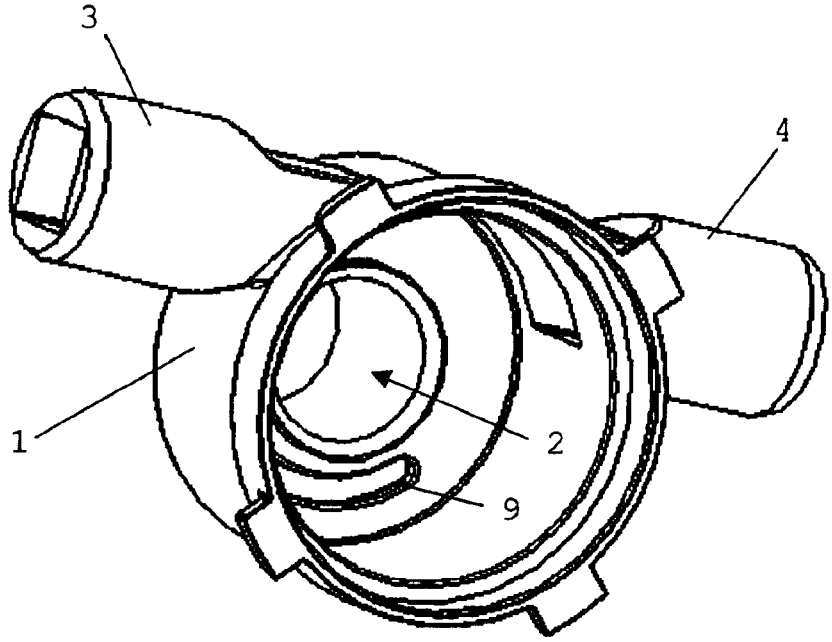
FIG. 1 is a first perspective view of the hydraulic body of an embodiment of the pump of the invention.
Figure 2:
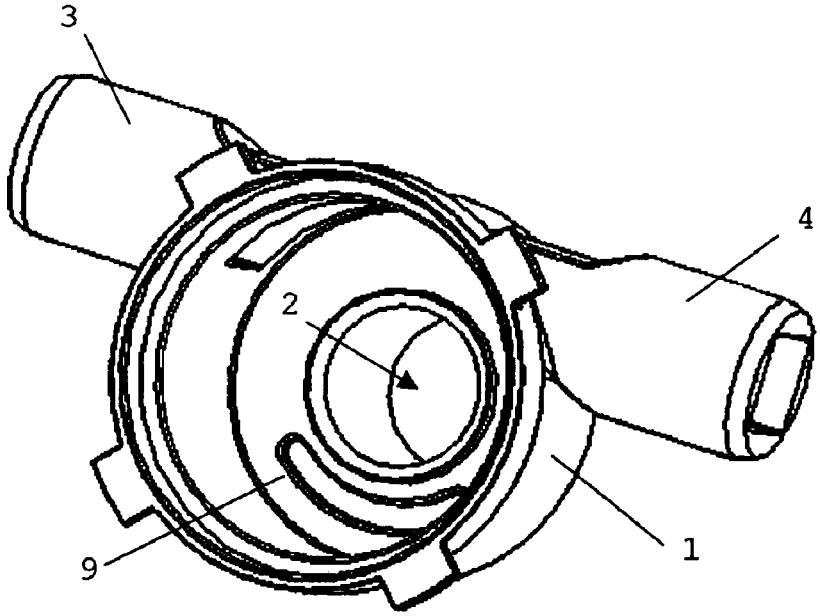
FIG. 2 is a second perspective view of the hydraulic body of FIG. 1.
Figure 3:
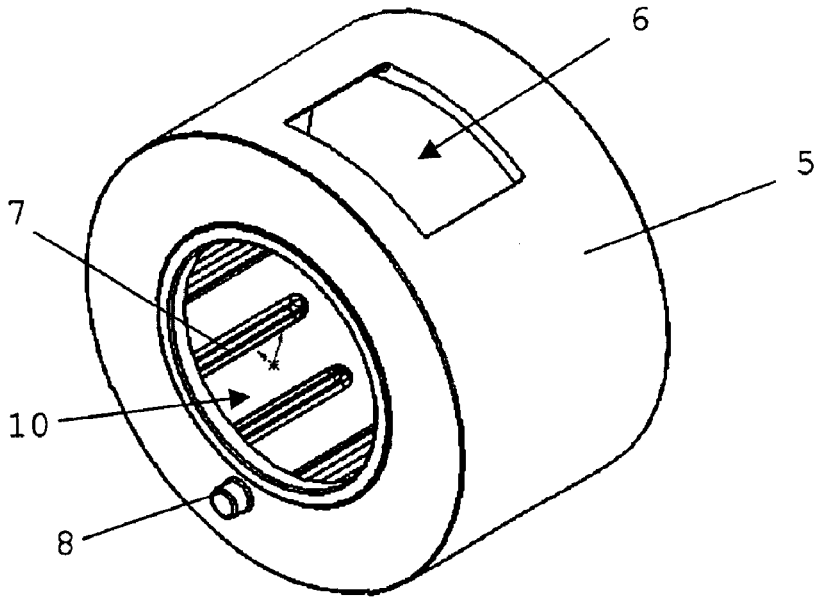
FIG. 3 is a first perspective view of the valve body of an embodiment of the pump of the invention.
Figure 4:
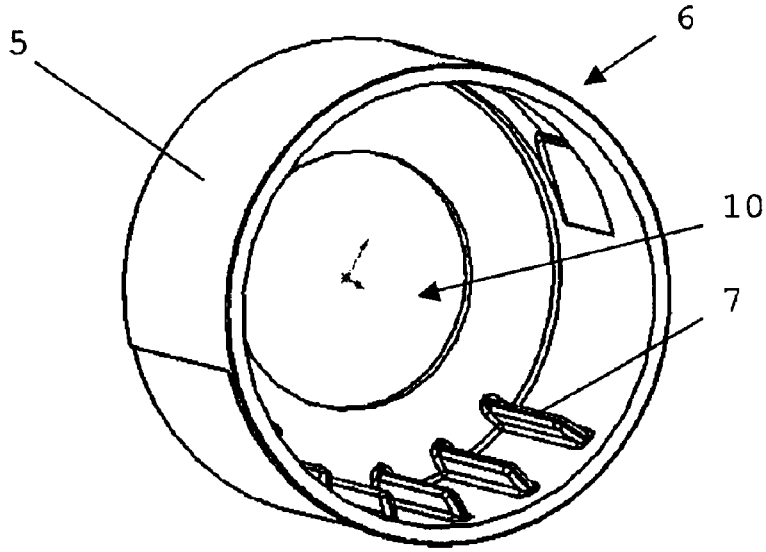
FIG. 4 is a second perspective view of the valve body of FIG. 3.

In the embodiment of the invention of FIGS. 1 to 4, the hydraulic pump of the invention comprises:

- a hydraulic body 1, shown in FIGS. 1 and 2, which has an inlet port 2 from which it receives a water flow, a first outlet port 3 and a second outlet port 4;
- an impeller, not shown in the figures, that is housed in said hydraulic body 1 and causes the movement of the water flow in one direction or the other, activated by a bidirectional motor which is not shown in the figures either; and
- a valve body 5, shown in FIGS. 3 and 4, which surrounds the impeller, the valve body 5 comprising at least one orifice 6, along with an orifice 10 that makes access of the water flow into the interior of the hydraulic body 1 possible.

The valve body 5 slides on the internal surface of the hydraulic body 1 in either direction, due to the action of the water flow, between a first position wherein the orifice 6 is aligned with the first outlet port 3 and a second position wherein the orifice 6 is aligned with the second outlet port 4.

As shown in FIGS. 3 and 4, in this embodiment the valve body 5 comprises a plurality of ribs 7 on its interior surface in order that the water flow displaces said valve body 5 in either one direction or the other.

On the other hand, the valve body 5 is slidable on the internal surface of the hydraulic body 1 by means of a sliding pin 8 and slot 9 connection, the pin 8 being placed on the valve body 5 and the slot 9 being placed on the hydraulic body 1.

In this embodiment, the hydraulic body 1 has a substantially cylindrical internal surface area, the inlet port 2 being coaxial with the turning axis of the impeller, and the outlet ports 3 and 4 being placed on the lateral peripheral surface of the hydraulic body 1. The valve body 5 is a hollow cylindrical body that is coaxial with the turning axis of the impeller, the orifice 6 being placed on the lateral peripheral surface of the hydraulic body 5. So, the valve body 5 moves with respect to the turning axis of the impeller. The valve body 5 has an orifice 10 coaxial with the turning axis of the impeller which, as a result of the circular movement of the valve body 5 with regard to the turning axis of the impeller, remains at all times aligned with the inlet port 2.

What is claimed is:

1. A bidirectional hydraulic pump comprising:

- a hydraulic body comprising an inlet port receiving a water flow, a first outlet port and a second outlet port;
- an impeller housed in said hydraulic body which direct said the water flow; and
- a valve body that surrounds said impeller, said valve body comprising at least one orifice, and said valve body being slidable on an internal surface of said hydraulic body as directed by said water flow, said valve body comprising on an inner surface at least one projection so that said water flow displaces said valve body, said valve body moving between a first position wherein said orifice is aligned with said first outlet port and a second position wherein said orifice is aligned with said second outlet port.

2. A bidirectional hydraulic pump as claimed in claim 1, wherein said at least one projection is a rib.

3. A bidirectional hydraulic pump as claimed in claim 1, wherein said valve body is slidable on said internal surface of said hydraulic body by means of a sliding pin and slot connection.

4. A bidirectional hydraulic pump as claimed in claim 1, wherein said hydraulic body has a substantially cylindrical inner surface, said inlet port being coaxial with a turning axis of said impeller, and said first and said second outlet ports being placed on a lateral peripheral surface of said hydraulic body, said valve body being a hollow cylindrical body that is coaxial with said turning axis of said impeller, and said orifice being placed on said lateral peripheral surface of said valve body.

* * * * *